United States Patent [19]

Calverley et al.

[11] Patent Number: 4,968,015

[45] Date of Patent: Nov. 6, 1990

[54] SHEET FEEDING APPARATUS AND METHOD

[75] Inventors: Simon G. Calverley; Trevor J. Conner; Christopher J. Dixon; Martin Lane, all of Hampshire; Roy E. Winchester, West Sussex, all of England

[73] Assignee: De La Rue Systems Ltd., United Kingdom

[21] Appl. No.: 345,216

[22] Filed: Apr. 28, 1989

[30] Foreign Application Priority Data

Apr. 29, 1988 [GB] United Kingdom ..... 8810244

[51] Int. Cl.[5] ..... B65H 5/22

[52] U.S. Cl. ..... 271/4; 271/10; 271/187; 271/315; 271/258; 271/265; 271/270; 271/272

[58] Field of Search ..... 271/4, 10, 3, 187, 315, 271/225, 258, 265, 266, 272, 270, 182, 184, 902; 377/8, 16, 2

[56] References Cited

U.S. PATENT DOCUMENTS

| | | | |
|---|---|---|---|
| 2,116,613 | 5/1938 | Bedford | 209/131 |
| 2,294,086 | 8/1942 | Hinds et al. | 209/147 X |
| 2,310,894 | 2/1943 | Brusset | 209/467 |
| 3,471,016 | 10/1969 | Eveson et al. | 209/470 |
| 3,642,271 | 2/1972 | Davis . | |
| 4,105,199 | 8/1978 | Sato et al. | 271/272 X |
| 4,279,740 | 7/1981 | Isogaya | 209/20 X |
| 4,451,357 | 5/1984 | La Vigne | 209/131 |
| 4,470,590 | 9/1984 | Ariga et al. | 271/187 |
| 4,650,991 | 3/1987 | Croset et al. | 356/381 X |
| 4,796,878 | 1/1989 | Nichelson et al. | 271/10 |

FOREIGN PATENT DOCUMENTS

| | | | |
|---|---|---|---|
| 0132329 | 1/1985 | European Pat. Off. | 271/4 |
| 130825 | 9/1985 | European Pat. Off. . | |
| 8402327 | 6/1984 | PCT Int'l Appl. . | |
| 2105690 | 3/1983 | United Kingdom | 271/187 |

*Primary Examiner*—Joseph J. Rolla
*Assistant Examiner*—David H. Bollinger
*Attorney, Agent, or Firm*—Ostrolenk, Faber, Gerb & Soffen

[57] ABSTRACT

Sheet feeding apparatus for example for use as a banknote counter comprises a stripper system having a pair of rollers; and a banknote detection system including two pairs of rollers defining respective nips into which single notes are fed by the stripper system. The relative deflection of the sheet detection system rollers due to the passage of a sheet through the nips is monitored in use. The stripper system rollers and the rollers of the sheet detection system are substantially coaxially mounted on a shaft and are driven by a common drive motor.

13 Claims, 9 Drawing Sheets

SHEET FEEDING APPARATUS AND METHOD

FIELD OF THE INVENTION

The invention relates to sheet feeding apparatus, for example sheet counting apparatus such as banknote counting apparatus. The invention also relates to methods for operating such apparatus.

DESCRIPTION OF THE PRIOR ART

In US-A-4650991 we describe and illustrate sheet feeding apparatus in which stripper means rollers are mounted on a stripper shaft positioned about a transport shaft carrying one of each pair of sheet transport means rollers to allow the rollers of the sheet transport means and the stripper means to be separately driven by respective motors. The advantage of this is that when the apparatus is used for batch feeding and the like, the stripper means rollers can be stopped to prevent the feeding of further sheets to the sheet transport means but the sheet transport means rollers can continue to rotate to clear all previously fed sheets out of the apparatus. This ability is also useful when the passage of overlapped sheets and other misfeeds is detected.

US-A-4474365 and WO-A-8402327 also describe a number of independantly driven rollers mounted about a common axis.

Although this apparatus has proved satisfactory to date, there is a general requirement to simplify the apparatus in order to reduce as far as possible the risk of break down and to reduce cost.

SUMMARY OF THE INVENTION

In accordance with one aspect of the present invention, sheet feeding apparatus for feeding sheets from a stack of sheets at an input store to a stacking position, comprises stripper means for drawing sheets out of the input store, the stripper means including at least one roller; transport means including at least one pair of rollers defining a nip into which single sheets are fed by the stripper means, whereby the at least one stripper means roller and one of each pair of transport means rollers are mounted non-rotatably to a common shaft; rotatable stacking means at the stacking position to which sheets are delivered by the transport means; and drive means for driving the stripper means, transport means and stacking means whereby the stacking means is actuable to continue to stack sheets when the stripper and transport means are controlled to prevent further sheets being fed.

This apparatus simplifies the known sheet feeding apparatus by mounting the stripper means and one of each pair of transport means rollers to a common shaft. This reduces cost and complexity and hence reduces the risk of break-down as well as enabling a reduction in the overall size of the apparatus to be achieved.

When such sheet feeding apparatus is used as sheet counting apparatus, it is necessary to detect the passage of sheets through the apparatus in order to count them. This can be done in any conventional manner, for example by using an optical technique but preferably the apparatus further comprises sheet detection means operable to detect the passage of a sheet through the transport means nip by monitoring relative deflection of the rollers defining the nip. This sheet detection means may take the form described in US-A-4650991.

In the case where the apparatus incorporates such sheet detection means, we provide in accordance with a second aspect of the present invention, a method of operating such sheet feeding apparatus, the method comprising monitoring the relative deflection of the transport means rollers before any sheets are fed by the stripper means and storing the monitored deflections to define a nip profile; and comparing subsequent deflections of the transport means rollers with corresponding parts of the stored profile.

With this method, a very simple method of detecting the passage of sheets and therefore counting them is provided. Typically, the profile may be updated at regular moments when no sheet is being fed through the nip.

When the sheet feeding apparatus is used to count batches of sheets (as opposed to a simple counting operation), it is necessary to prevent sheets from being withdrawn from the stack at the input store as soon as the required number has been withdrawn while allowing all the withdrawn sheets to be fed through the apparatus and be stacked at the stacking position. In our earlier apparatus, this is achieved by stopping the stripper means but allowing the transport means and stacking means to continue to rotate. In the present case, this is more difficult since stopping the stripper means will automatically cause the transport means also to stop.

In one example of the invention we deal with this problem by providing common drive means connected by a first transmission to the stripper and transport means, the stacking means being rotated via a subsidiary transmission between the stacking means and the stripper and transport means, the drive means also being connected to the stacking means by a selectively actuable second transmission whereby when the second transmission is actuated by reverse movement of the drive means this causes the stacking means to rotate so as to stack sheets, the arrangement being such that when the second transmission is actuated any drive coupled to the stacking means via the first and subsidiary transmissions is overidden.

Although in theory separate drive motors could be used to rotate the stacking means and stripper/transport means separately, it is much simpler to provide common drive means and in this example by suitably linking the common drive means via two transmissions with the stacking means, it is possible to stop further sheets being drawn from the store by braking and halting the stripper, transport and stacking means, as the last sheet in the batch leaves the transport means. The consequence of the braking is that the transport means and stacking means stop quickly and thus notes remain in the stacking means. The drive means is then quickly reversed for a short period of time and when this occurs the second transmission overrides the first and thus the stacking means completes the stack whilst the transport and stripper means reverse. The drive ratios are such that sufficient stacking movement is achieved with minimal transport means reversal.

Conveniently, the second transmission comprises a drive belt coupled between the common drive means and the stacking means via a single direction freewheel clutch. The single direction freewheel clutch could couple a drive pulley with the common drive means or be provided to connect a shaft to which the stacking means is connected with a pulley about which the drive belt is entrained.

In the preferred arrangement, the first transmission comprises a toothed drive belt connected between the drive means and the shaft to which the at least one stripper means roller and the one of each pair of transport means rollers are non-rotatably mounted. Alternatively, a plain 'O' ring could be used.

Preferably, the subsidiary transmission comprises a drive belt coupled between the shaft and the stacking means, the drive belt being adapted to slip when the stacking means is driven via the second transmission.

The preferred method of operating sheet feeding apparatus according to the first example in order to generate a stack of N sheets (batch operation) comprises operating the stripper and transport means and stacking means at a first speed; counting sheets drawn out of the input store and, when a predetermined number of sheets X, where N>X, has been counted, causing the stripper means, transport means and stacking means to operate at a lower, second speed; and when the Nth sheet has been withdrawn from the store braking the drive means and halting the stripper, transport, and stacking means and then reversing the drive means such that the second transmission drives the stacking means to complete the stack.

The initial braking and halting of the whole mechanism prevents further sheets from being drawn from the store by the stripper means.

We have found that instead of attempting to abruptly stop the stripper/transport means from its normally high operational speed (eg 1000–1400 rpm), it is preferable to control the stopping operation by firstly reducing the speed of operation to an intermediate value and thereafter stopping further feed and then cause the stacking means to continue to stack sheets.

In a second example, common drive means is provided to drive the stripper means, transport means, and stacking means, the stacking means being mounted non-rotatably on a shaft coupled via a single direction free-wheel clutch to the common drive means, whereby the stacking means can continue to rotate after the stripper and transport means have stopped.

The preferred method of operating sheet feeding apparatus according to this second example in order to generate a stack of N sheets comprises operating the stripper and transport means and stacking means at a first speed; counting sheets drawn out of the input store and, when a predetermined number of sheets X, where N>X, has been counted, causing the stripper means, transport means and stacking means to operate at a lower, second speed; and when the Nth sheet has been withdrawn from the store, braking the stripper and the transport means to prevent further sheets being drawn from the store, the stacking means continuing to rotate so as to stack the sheets already fed out of the store.

In both examples, the stripper and transport means rollers mounted to the shaft may be provided as separate roller members but conveniently are formed by a common cylindrical member which simplifies construction of this part of the apparatus.

BRIEF DESCRIPTION OF THE DRAWINGS

Some examples of banknote counting apparatus in accordance with the present invention will now be described with reference to the accompanying drawings, in which.

Figure 1:
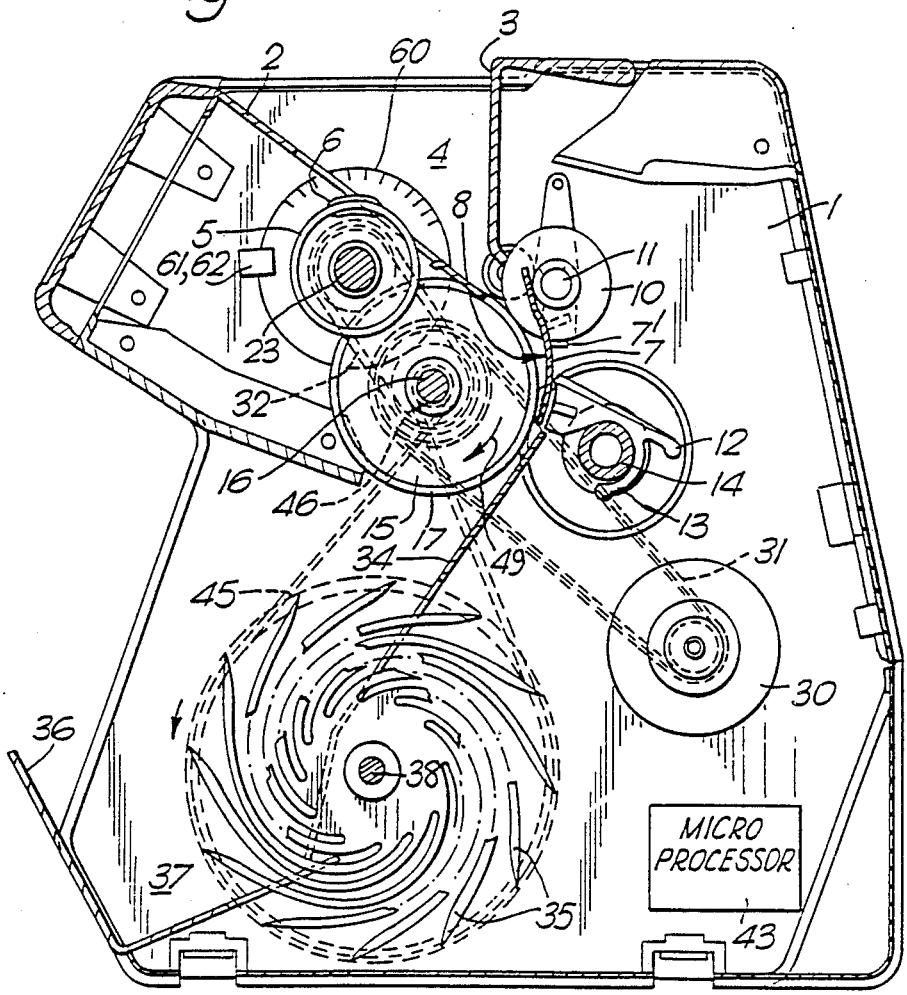
FIG. 1 is a diagrammatic side view of the apparatus.

The apparatus illustrated in the drawings is a banknote counting apparatus.

DETAILED DESCRIPTION OF THE EMBODIMENTS

The apparatus comprises two metal side plates 1 supporting a feed plate 2 and a face plate 3 of an input hopper 4. Three conventional picker wheels 5 are rotatably mounted to the side plates 1 and have radially outwardly projecting bosses 6 which, as the picker wheels rotate, periodically protrude through slots in the feed plate 2.

A guide plate 7 having a curved guide surface 8 is pivotally mounted by an arm 7' to a shaft 11 which is located via the face plate 3. Two separation rollers 10 (only one shown in the drawings) are mounted for rotation with the shaft 11 journalled via the face plate 3. Other separation means such as stationary shoes could also be used. A cantilevered arm 12 is connected to the guide plate 7 and includes a spring clip 13. When the guide plate 7 is in its first position shown, the spring clip 13 is located around a stationary shaft 14. If it is desired to cause the plate 7 to pivot away from its first position, the clip 13 is simply unclipped from the shaft 14 and pivoted in an anti-clockwise direction (as seen in FIG. 1) allowing the operator access to the note feed path so that a note jam can be cleared.

A pair of transport rollers 15 are non-rotatably mounted to a transport shaft 16 which is rotatably mounted to the side plates 1. Each transport roller 15 has an outer annular portion 17 of rubber. Each transport roller 15 contacts a respective auxiliary roller 18 rotatably mounted on the shaft 14. The transport rollers 15 (and auxiliary rollers 18) are axially spaced apart by a distance less than the width of sheets being counted.

A pair of stripper rollers 19 having rubber inserts 19' are non-rotatably mounted on the shaft 16. The stripper rollers 19 are positioned so as to define a small separation gap with the separation rollers 10 opposite which they are mounted. (A single wide stripper roller could be used in place of the rollers 19)

The rollers 15, 19 have substantially the same outer diameter.

Figure 2:
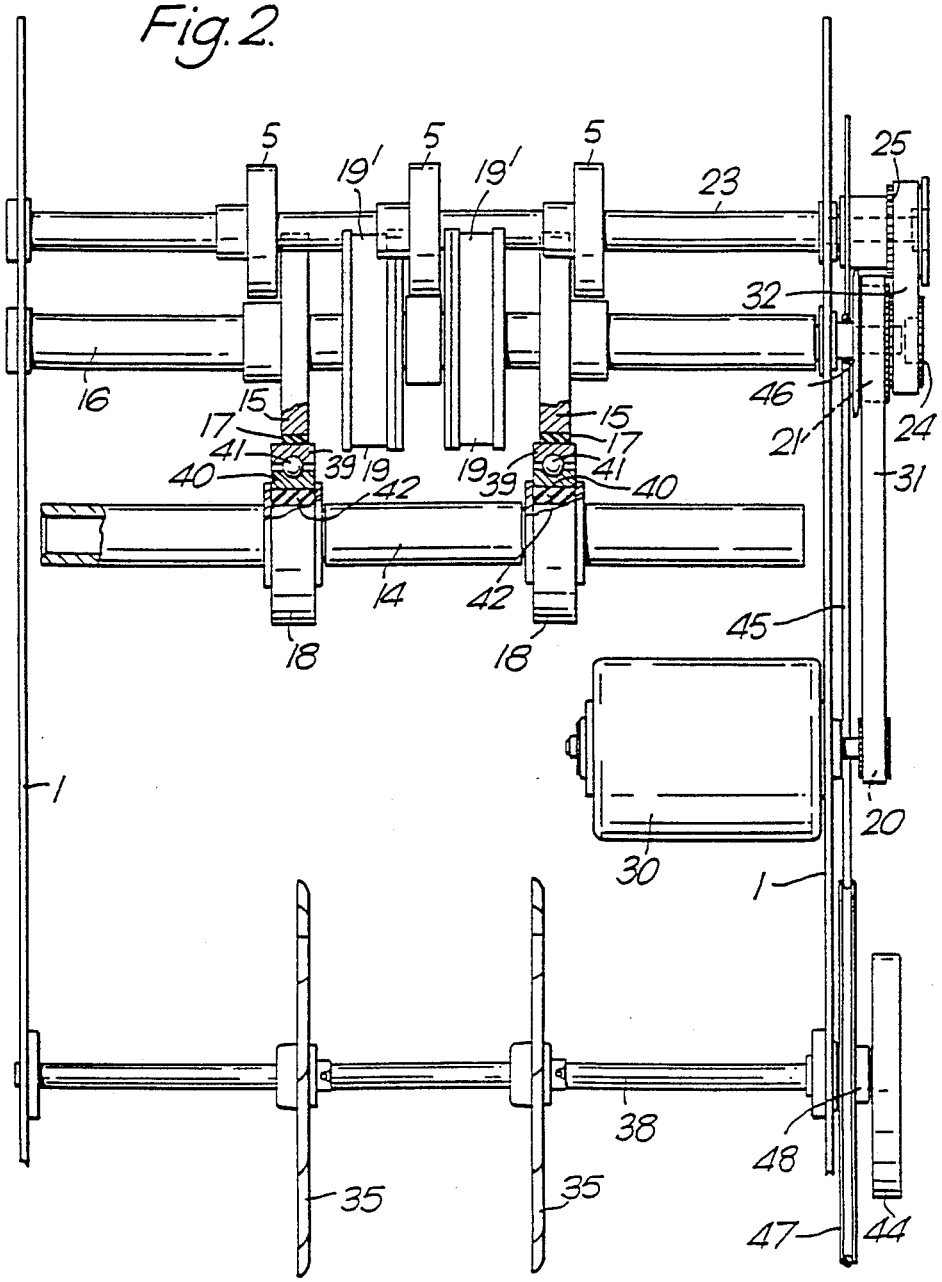
FIG. 2 is a partial cross-section through part of one example of the apparatus with parts omitted for clarity.

A drive motor 30 drives the shaft 16 via a toothed drive belt 31 entrained about pulleys 20, 21 (FIG. 2). The picker wheels 5 are mounted non-rotatably on a shaft 23 which is driven from the shaft 16 via a toothed drive belt 32 entrained about pulleys 24, 25.

A guide plate 34 extends from adjacent the nips formed between the rollers 15 and auxiliary rollers 18 to a pair of conventional stacker wheels 35 rotatably mounted between the side plates 1 on a shaft 38. The guide plate 34 together with an end plate 36 define an output hopper 37.

A flywheel 44 is mounted non-rotatably to the shaft 38 while the shaft is driven from the shaft 16 via a crossed belt 45 entrained around a pulley 46, coupled with the shaft 16, and a pulley 47 coupled to the shaft 38 via a single direction free wheel clutch assembly 48, such as a Torrington clutch.

Figure 3:
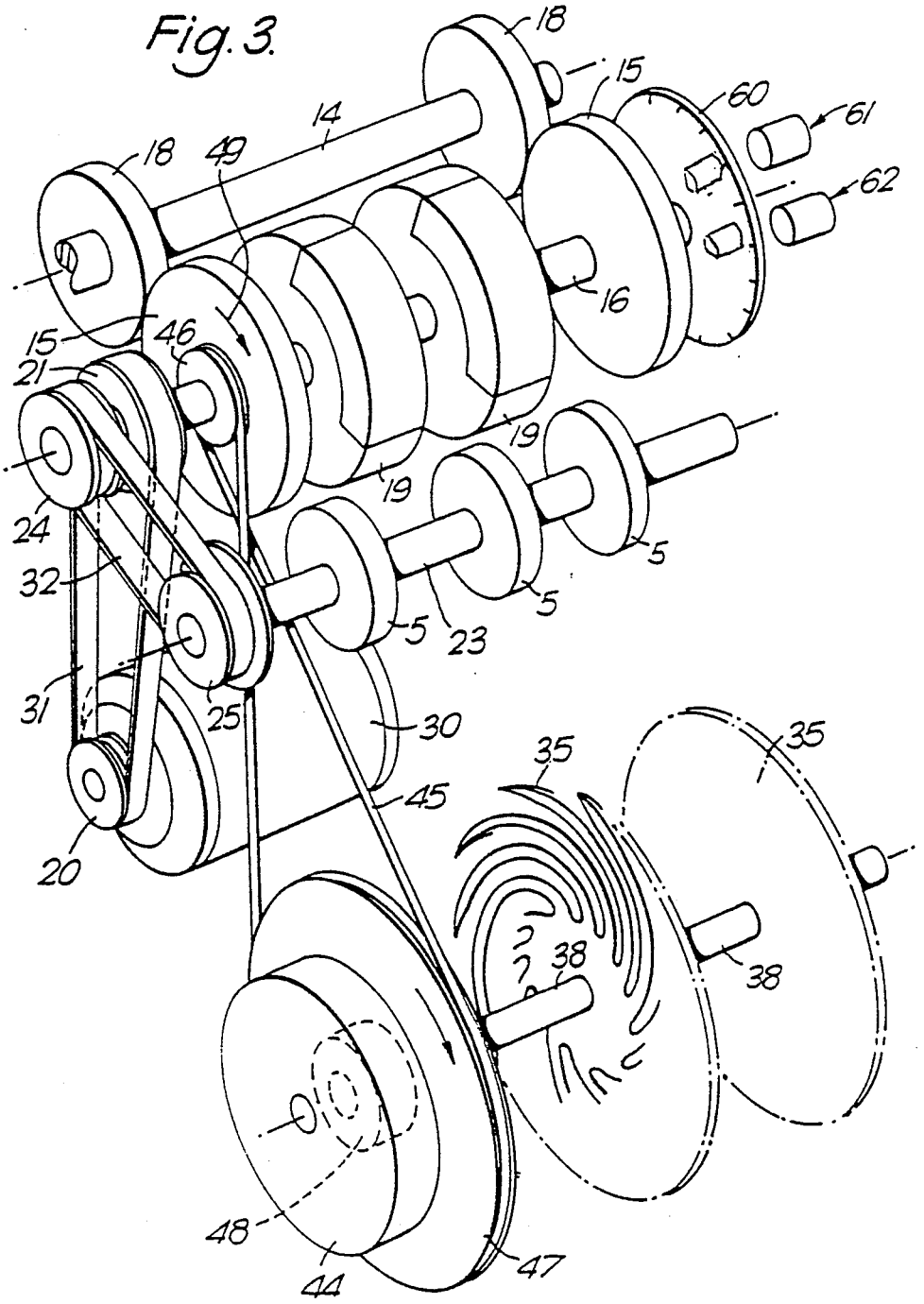
FIG. 3 is a schematic perspective view of the apparatus shown in FIG. 2.
Figure 4:
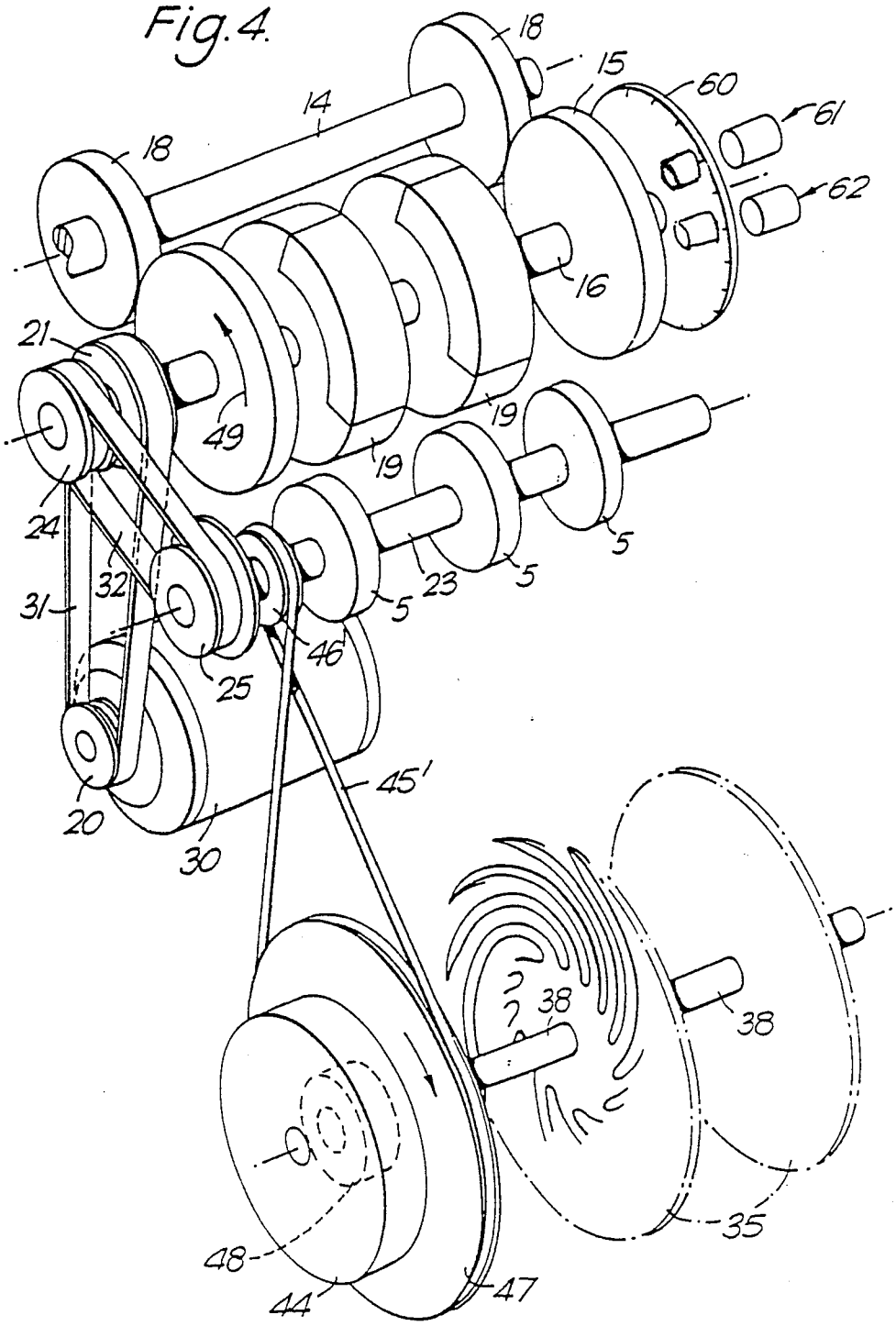
FIG. 4 illustrates a modification of the FIG. 3 example.

A modification of the apparatus shown in FIG. 3 is illustrated in FIG. 4 in which the shaft 38 is driven via a crossed belt 45' and entrained around a pulley 46' coupled with the shaft 23.

The rollers 15 and auxiliary rollers 18 define sheet sensing apparatus for detecting the passage of two or more notes simultaneously and for counting banknotes using the method described in US-A-4650991 the disclosure of which is incorporated herein by reference.

In summary, the shaft 14 is hollow, and is non-rotatably supported by the side plates 1, and carries the two auxiliary rollers 18. These are identical in construction and each contacts a respective one of the rollers 15.

Each roller 18 comprises a roller bearing having an annular outer race 39, an annular inner race 40 and bearing balls 41 positioned between the inner and outer races. The bearing is mounted coaxially about the shaft 14 on an annular rubber portion 42. A pin (not shown) abuts the radially inner surface of the inner race 40 and extends through the rubber portion 42 and an aperture in the shaft 14 into the shaft.

Two light emitter/sensor pairs (not shown) are mounted in the shaft 14 on each side of respective pins so as to monitor radial movement of the pins. The output signals from the sensors are digitised and fed to a microprocessor 43 which processes them in the manner to be described.

The basic mode of operation is as follows. A stack of banknotes is placed in the hopper 4 and the drive motor 30 activated. Rotation of the drive motor so as to cause the rollers 15, 19 to rotate in a feed forward direction as indicated by an arrow 49 in FIG. 3 will also cause rotation of the shaft 38 carrying the stacking wheels 35 due to engagement of the clutch assembly 48. After suitable rotation of the rollers 15, 19 has taken place for the purpose to be described below, the projecting bosses 6 of the picker wheels 5 will engage the lowermost note in the stack and nudge this forward into the separation gaps between the rollers 19 and separation rollers 10. Rotation of the rollers 19 will bring the rubber portions 19' into contact with a surface of the fed sheet to carry that sheet alongside the guide 7 into the nips between the rollers 15 and 18. Since the rollers 15, 19 have substantially the same diameter and they are all mounted non-rotatably on the same shaft 16, the note will be fed at substantially the same speed by both sets of rollers. After passing through the nips, the note will pass into slots of the stacking wheels 35 which will rotate in an anti-clockwise direction, as seen in FIG. 1, so that the notes will be stripped from the slots by plate 34 and be stacked in the hopper 37.

The processing of output signals from the detection system and the subsequent control of the apparatus in will now be described.

Initially, when power is first applied and there are no notes in the input hopper 4, the rollers 15, 18 undergo at least one full rotation. This rotation is monitored via a timing disc 60 (FIG. 1) mounted for rotation with the shaft 16 (or alternatively shaft 23) and primary and secondary light sensor/emitter pairs 61, 62 (FIG. 3). The timing disc 60 has forty equally spaced slots extending around its circumference. The output signals generated by the sensors of the pairs 61, 62 are fed to conventional digitising means (such as analogue/digital converters) and the digitised signals are then fed to the processor 43. The processor 43 responds to the signals from the two detection system sensors previously described (related to the deflection of the rollers 18) and stores the values of those output signals each time the primary sensor/emitter pair 61 detects the passage of a slot. The sampled values from the detection system are stored so as to constitute a profile of each nip. During subsequent operation, as sheets are drawn from the stack in the input hopper 4 and fed into the nips, the output signals from the detection system will change since the pins will be depressed further into the shaft 14. This will cause changes in the output signals from the detection system which can then be compared with the stored profiles by resampling the output signals at exactly the same angular positions as the original signals were sampled to generate the profile. This sampling is again controlled by the timing disc 60 and the primary emitter/sensor pair 61. As is explained in detail in US-A-4650991, the comparison of the output signals from the detection system with the stored profiles provides an indication of the passage of notes and thus this can be used to increment a counter.

The profile of the nips can be updated at any convenient time when no note is present in the nips. Typically, the profile will be updated at times when no notes are present in the input hopper 4 so that the roller system can be safely rotated without the risk of drawing a new note into the nips. In addition, the profile could be reviewed during the passage of a batch of notes whenever no note is present in the nips. Since the timing disc 60 provides an accurate indication at all times of the positions of the rollers 15 relative to the nips, it is always possible for the processor 43 to determine whether the profile at that position should be updated.

This exact position of the rollers 15 at the nips could be monitored by monitoring the sensor outputs from the sensor of the primary pair 61 to obtain the magnitude of any rotation of movement whilst detecting the polarity of back emf from the permanent magnet of the drive motor 30 to obtain direction of rotation. In the present examples, however, the secondary sensor/emitter pair 62 is provided so that transitions from an obscured state to a clear state for one of the sensor/emitter pairs occurs midway between similar transitions for the other sensor/emitter pair. The signals from the two sensors thus provide an unambiguous truth table which indicates the direction of any movement of the timing disc 60.

It is possible that when the drive motor 30 is stopped due to the counting of a full batch or, for example, due to the detection of a double feed or other error condition, a note may be positioned within the nips. Since the rollers 15 are stopped at the same time as the drive motor 30, the note will remain in the nips.

If the drive motor 30 is subsequently restarted the counting process may continue since the exact position of the rollers 15 is continuously monitored by the processor 43 by way of the timing disc 60 enabling data already deduced for the first part of the note to be used together with data for the second part of the note which will be detected on restart. If the note remaining in the nip is the last note and it has gone in sufficiently for a feed hopper sensor to clear then an error indication will be signalled on a display. This ensures the note is not left in the machine and forgotten. Once again, the exact position of the rollers 15 will be continuously monitored via the disc 60 when the note is pulled out.

The apparatus shown in FIGS. 1 to 4 can be used for a variety of purposes including the batching of notes so as to generate a series of batches of a known number of notes or in a straightforward counting mode to count the total number of notes positioned in the input hopper 4. In the former case, the motor 30 will need to be stopped at the end of each batch. As soon as the motor 30 is stopped, rotation of the shaft 16 and the shaft 23 will also stop thus preventing further notes from being fed out of the input hopper 4. However, due to the presence of the clutch assembly 48, the shaft 38 and stacking wheels 35 will continue to rotate under the influence of their own inertia and that of the flywheel 44 so that any sheets already fed into the slots of the stacking wheels 35 will be carried to the stacking position and be stripped out of the stacking wheel. This ensures that no notes will be inadvertently left in the apparatus after having been counted.

Although in the ideal example, the transport and stripper rollers 15, 19 will be stopped instantaneously, in practice at typical operating speeds of between 1000 and 1400 rpm this is not feasible due to the inertia of the system. This is a particular problem in the case of batch operation in which it is essential that only the required number of sheets (N) is drawn out of the hopper 4.

Figure 6:
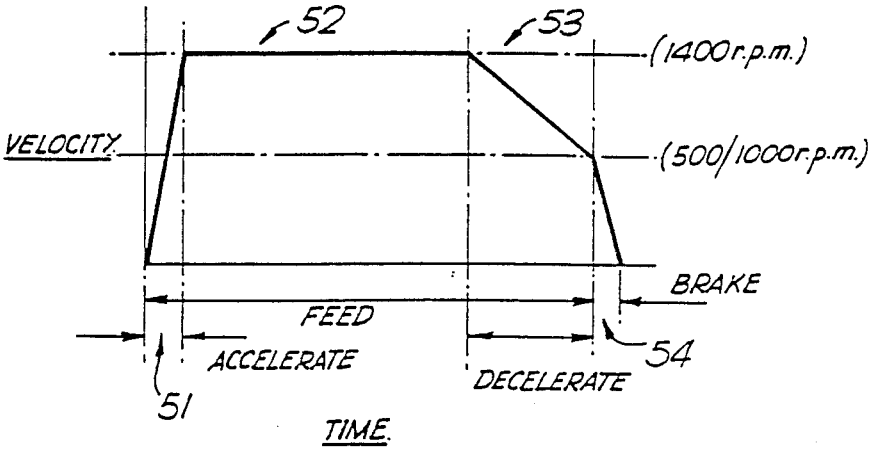
FIG. 6 illustrates graphically the batch operation of the FIG. 3 example.

In order to cope with these problems, we have developed a special mode of operation which is illustrated graphically in FIG. 6. At start-up, the stripper and transport rollers 15, 19 are rapidly accelerated during an initial phase 51 to a terminal velocity of about 1400 rpm. This velocity is maintained during a phase 52 during which a majority of the batch of sheets is fed from the input hopper 4 to the output hopper 37. Towards the end of the batch, for example on the detection of the 98th sheet of a batch of 100, the drive motor 30 is decelerated during a phase 53 to an intermediate speed of for example 500 rpm and then is rapidly braked during a final braking phase 54. In this way, the stripper rollers 19 can be stopped between the time that the last sheet in the batch leaves the transport rollers 15 and the time at which the next sheet in the input hopper 4 is picked up. At the same time, the stacker wheels 35 will continue to rotate under the influence of the flywheel 44 for a sufficiently long time to enable all remaining sheets held by the stacker wheels 35 to be stacked in the output hopper 37. The exact choice of durations for the phases 53, 54 and of the intermediate speed are determined empirically.

For optimum stacking performance it is important that the ideal note/stacking wheel velocity relationship is maintained during phases 53 and 54.

With a simple freewheeling stacker system as described in FIGS. 3 and 4 this is not practical ie the stacker mechanism must slow down at the same rate as the stripper and transport mechanisms slow and then still have enough momentum to clear the stacker after the last note is fed. It must also do this over the variations in assembly tolerances and generating temperatures etc.

Figure 5:
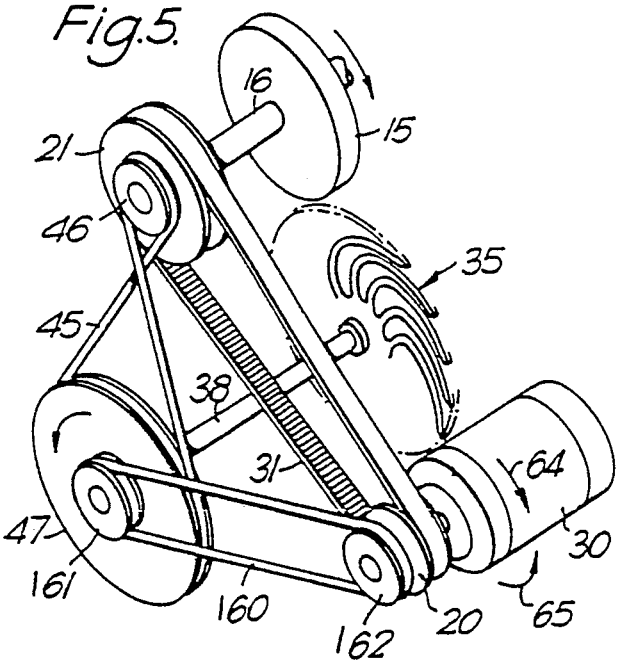
FIG. 5 illustrates part of a modified form of the FIG. 3 example.
Figure 8:
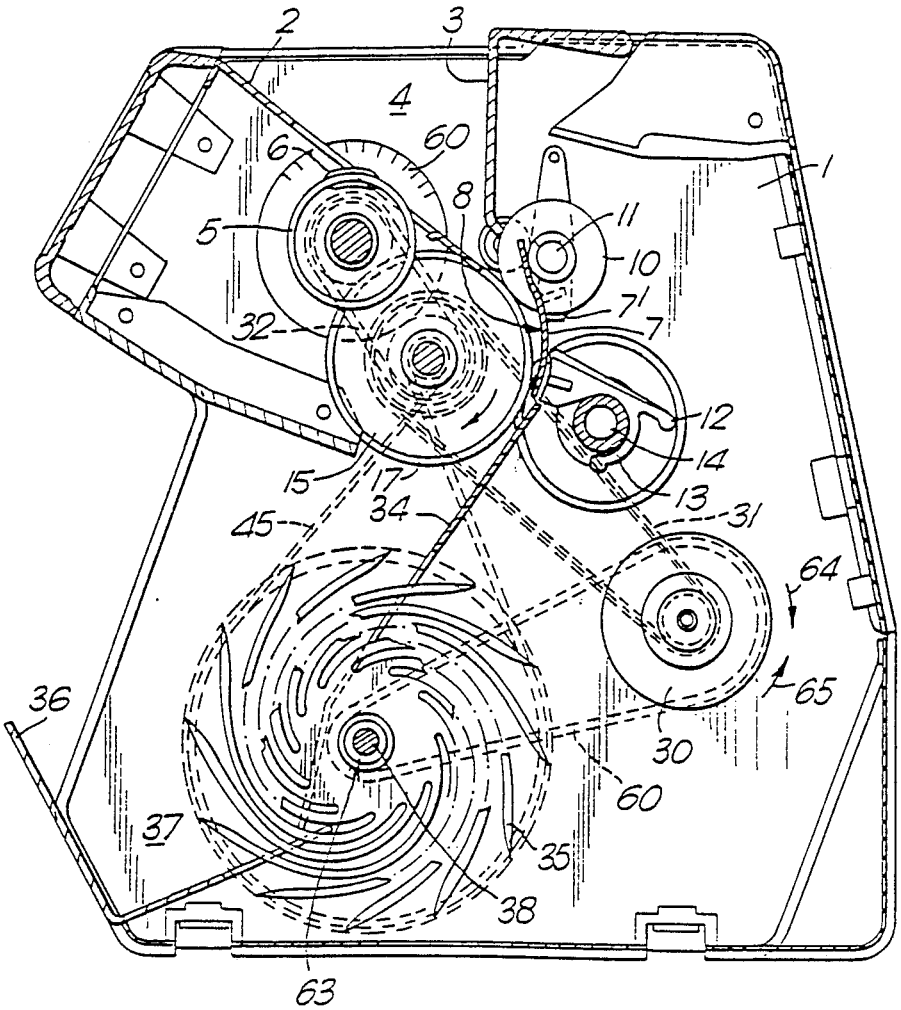
FIGS. 8 and 9 are views similar to FIGS. 1 and 2 respectively but of the FIG. 5 example; and, FIGS. 10 and 11 illustrate two further examples.
Figure 9:
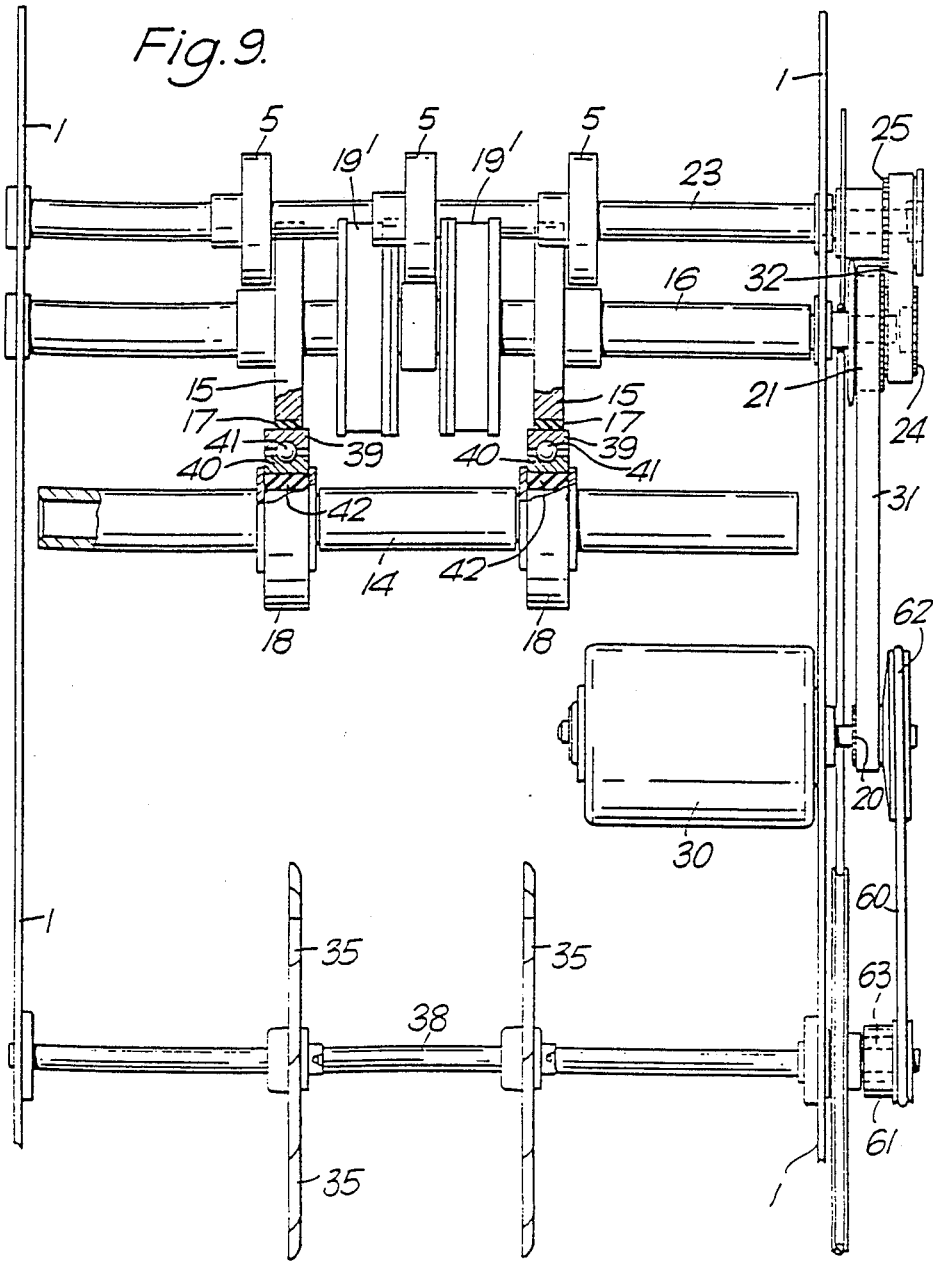

In order to maintain this optimum stacker/note relationship we have devised a modified arrangement of FIG. 3 which is shown in FIGS. 5, 8, and 9.

This arrangement is similar to that shown in FIG. 3 except that the pulley 47 is directly connected to the stacker wheel shaft 38 instead of via a Torrington clutch. In this example, the drive belt 31 and pulleys 20, 21 constitute a first transmission while the belt 45 constitutes a subsidiary transmission for driving the stacker wheel shaft 38 from the transport/stripper shaft 16. In addition, a second transmission is provided constituted by a drive belt 160 entrained around pulleys 161, 162 coupled with the stacker wheel shaft 38 and the drive motor 30 respectively. The pulley 161 is coupled to the shaft 38 via a Torrington clutch 63.

During normal operation, the drive motor 30 causes rotation in the direction of the arrow 64 and corresponding rotation of the shafts 16, 38 so that sheets will be stacked in the manner described above. During this rotation, no drive is imparted to the pulley 47 by virtue of the clutch 63. Upon detection of the passage of the Xth sheet towards the end of a batch, for example the 95th sheet out of a batch of 100, the drive motor 30 is caused to slow down as described earlier (phase 53, FIG. 6) and then as the last note leaves the transport nip the brake is applied which halts the feed, transport and stacker shafts. During this decleration and braking period the optimum stacker/note speed relationship is maintained as the stacker is directly driven from the transport via belt 45.

At the instant at which the mechanism stops there are now notes in the stacking wheel tines which have yet to be finally stacked in hopper 37. To complete the stack, having first stopped, the motor is instantly reversed for a short time eg 60° of one rotation in the direction of arrow 65. This reverse movement is coupled to the drive belt 160 as well as to the toothed drive belt 31. The reverse movement will cause a small angular reverse rotation of the rollers 15, 19 which in the absence of the drive belt 160 would cause reverse movement of the stacker wheels 35. However, the connection between the drive belt 160 and the pulley 161 is designed to override the connection between the drive belt 45 and the pulley 47 so that in its simplest form for example the drive belt 45 slips whilst the drive belt 160 acts to rotate the shaft 38. It will be seen that since the drive belt 45 is crossed and the drive belt 160 is not crossed, reverse rotation of the motor 30 will cause the stacker shaft 38 to continue to rotate in the same, stacking direction. This reverse movement is continued for such a time as to ensure all sheets in the batch have been stacked. Clearly, no sheets will be withdrawn from the input hopper 4 due to the reverse movement of the stripper rollers 19.

Figure 7A:
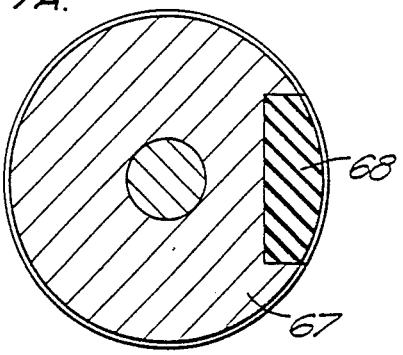
FIGS. 7A–7C are a section on the line X—X, a plan, and an end view respectively of a composite stripper/-transport member.
Figure 7B:
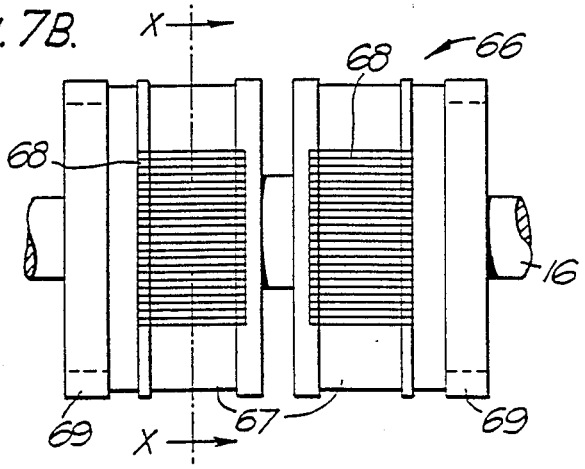
Figure 7C:
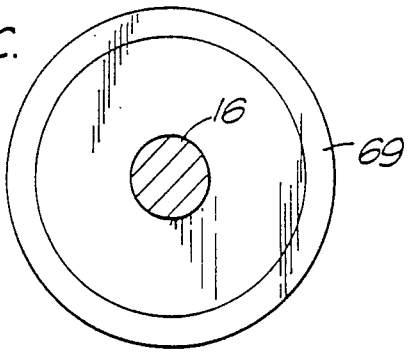

In all the previous examples, the stripper rollers 19 and transport rollers 15 have been shown as separate rollers mounted on a shaft 16. A modified form of this arrangement is shown in FIG. 7 in which the stripper and transport rollers have been formed from a common member 66 having two axially inner circumferential portions 67 defining the stripper rollers (each having a rubber insert 68) and two axially outer, cylindrical portions 69 defining respective transport rollers.

Figure 10:
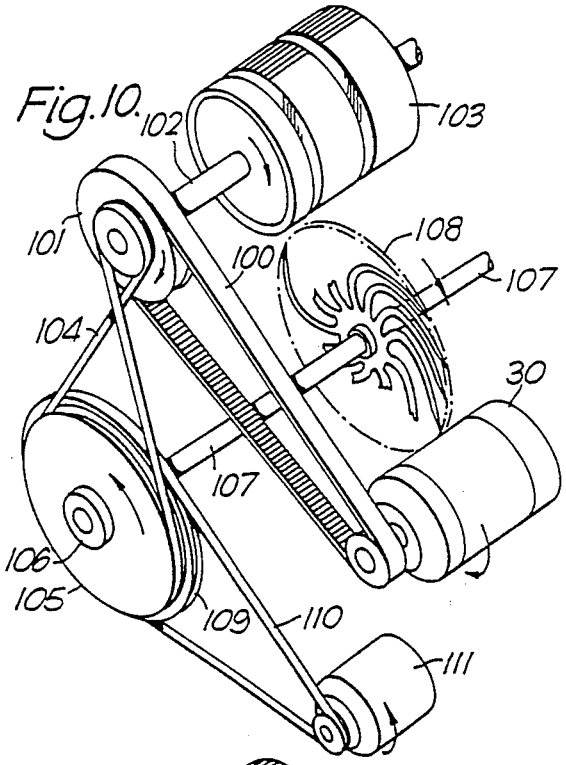

Another example is shown in FIG. 10. In this example, the transport motor 30 is coupled via a toothed belt 100 with a pulley 101 non-rotatably mounted on the transport and stripper shaft 102. The transport and stripper assembly is shown schematically at 103. A crossed belt 104 couples the shaft 102 with a pulley 105 mounted via a one-way clutch 106 to the stacker shaft 107. Stacking wheels 108 are shown schematically non-rotatably mounted to the shaft 107. The shaft 107 carries a second pulley 109 coupled via a one-way clutch (not shown) to the shaft and driven via a belt 110 from an auxiliary motor 111.

During normal note feeding, the stacker shaft 107 is driven from the transport drive motor 20 via belts 104 and 100 with the auxiliary motor 111 switched off, the clutch system allowing the auxiliary motor belt 110 to remain stationary. When the last sheet of a batch leaves the transport nip, the transport is stopped in the same manner as described above, at which point the auxiliary motor 111 is switched on. The auxiliary motor 111 now drives the stacker shaft 107 via the pulley 109 and its associated clutch, the clutch 106 allowing the belt 100 to remain stationary. After a predetermined length of time the auxiliary motor 111 is switched off. In this way, the final sheets fed by the transport system are stacked.

In some cases, operation of the auxiliary motor 111 and transport motor 20 could overlap. In this case, the clutch system is such that the faster of the two drives, preferably the transport drive motor 20, will drive the stacker wheels 108, the other system idling.

Figure 11:
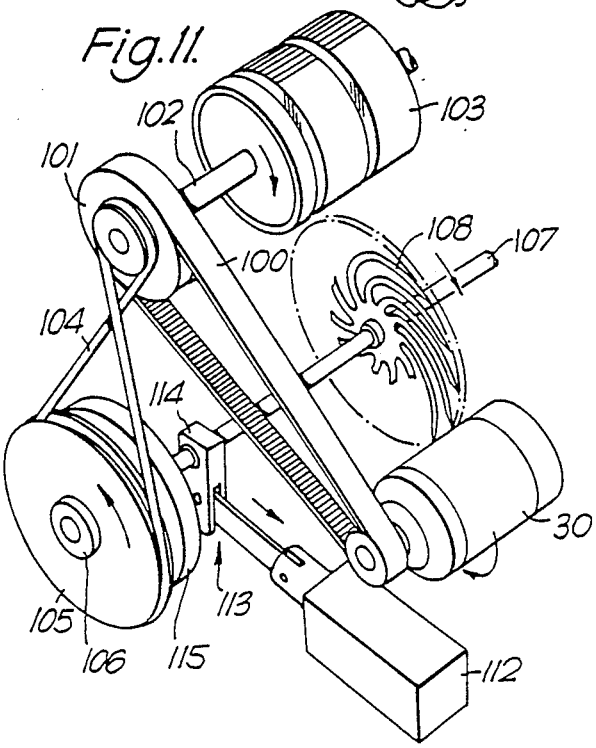

FIG. 11 illustrates a modification of the FIG. 10 example in which instead of the auxiliary motor 111, a solenoid 112 is provided connected to the shaft 107 via a double linkage 113 and a one-way clutch 114. In addition, a flywheel 115 is non-rotatably mounted to the stacker shaft 107.

During normal note feeding, the stacker shaft 107 is driven from the transport drive motor 20 via belts 100 and 104 with the one-way clutch 114 free wheeling. When the last note of the batch leaves the transport nip, the transport is stopped as before. The flywheel/clutch arrangement associated with the stacker shaft 107 ensures that the stacker shaft continues to rotate for a short period. Before the stackers come to rest, the solenoid 112 is activated giving the shaft and flywheel a "kick" in the form of a short impulsive, rotational force which prolongs this run-on period to ensure that all notes are stacked correctly.

We claim:

1. Sheet feeding apparatus for feeding sheets from a stack of sheets at an input store to a stacking position, the apparatus comprising stripper means for drawing sheets out of said input store, said stripper means including at least one roller; transport means including at least one pair of rollers defining a nip into which single sheets are fed by said stripper means; rotatable stacking means for stacking the sheets, said rotatable stacking means located at said stacking position to which sheets are delivered by said transport means; drive means for driving said stripper means, transport means and said stacking means, and means for enabling said stacking means to continue to stack sheets when said stripper and transport means are controlled to prevent further sheets being fed, said at least one stripper means roller and one of each pair of said transport means rollers being mounted non-rotatably to a common shaft.

2. Apparatus according to claim 1, wherein said drive means is commonly connected by a first transmission to said stripper and transport means, said stacking means being rotated via a subsidiary transmission between said stacking means and said stripper and transport means, said drive means also being connected to said stacking means by a selectively actuable second transmission whereby when said second transmission is actuated by reverse movement of said drive means this causes said stacking means to rotate so as to stack sheets, when said second transmission is actuated any drive coupled to said stacking means via said first and subsidiary transmissions is overridden.

3. Apparatus according to claim 2, wherein said second transmission comprises a drive belt coupled between said common drive means and said stacking means via a single direction freewheel clutch.

4. Apparatus according to claim 2, wherein said first transmission comprises a toothed drive belt connected between said drive means and said shaft to which said at least one stripper means roller and said one of each pair of transport means rollers are non-rotatably mounted.

5. Apparatus according to claim 4, wherein said subsidiary transmission comprises a drive belt coupled between said shaft and said stacking means, said drive belt being adapted to slip when said stacking means is driven via said second transmission.

6. Apparatus according to claim 1, wherein said drive means commonly drives said stripper means, said transport means, and said stacking means, said stacking means being mounted non-rotatably on a shaft coupled via a single direction free-wheel clutch to said common drive means, whereby said stacking means can continue to rotate after said stripper and transport means have stopped.

7. Apparatus according to claim 6, further comprising an auxiliary drive coupled with said stacking means shaft, said auxiliary drive being actuable when said stripper and transport means are controlled to prevent further sheets being fed to cause said stacking means to continue to stack sheets for a predetermined period.

8. Apparatus according to claim 6, further comprising a shaft actuator coupled with said stacking means shaft and actuable to impart an impulsive, rotational force on said stacking means shaft when said stripper and transport means are controlled to prevent further sheets from being fed.

9. Apparatus according to claim 1, wherein said stacking means includes at least one rotatable stacking wheel having a plurality of radially outwardly opening sheet receiving slots.

10. Apparatus according to claim 1, further comprising sheet detection means operable to detect the passage of a sheet through said transport means nip by monitoring relative deflection of said roller defining said nip.

11. A method of operating sheet feeding apparatus for feeding sheets from a stack of sheets at an input store to a stacking position, the apparatus comprising stripper means for drawing sheets out of said input store, said stripper means including at least one roller; transport means including at least one pair of rollers defining a nip into which single sheets are fed by said stripper means; rotatable stacking means for stacking the sheets, said rotatable stacking means located at said stacking position to which sheets are delivered by said transport means; drive means for driving said stripper means, transport means and said stacking means; and means for enabling said stacking means to continue to stack sheets when said stripper and transport means are controlled to prevent further sheets being fed, said at least one stripper means roller and one of each pair of said transport means rollers being mounted non-rotatably to a common shaft, the apparatus further comprising sheet detection means operable to detect the passage of a sheet through said transport means nip by monitoring relative deflection of said rollers defining said nip, the method comprising: monitoring the relative deflection of said transport means rollers before any sheets are fed by said stripper means and storing said monitored deflections to define a nip profile; and compairing subsequent deflections of said transport means rollers with corresponding parts of said stored profile.

12. A method of operating sheet feeding apparatus for feeding sheets from a stack of sheets at an input store to a stacking position, in order to generate a stack of N sheets, the method comprising operating said stripper and transport means and stacking means at a first speed; counting sheets drawn out of said input store and, when a predetermined number of sheets X, where N>X, has been counted, causing said stripper means, transport means and stacking means to operate at a lower, second speed; and when the Nth sheet has been withdrawn from said store and fed out of said transport means nip braking said drive means and halting said stripper, transport, and stacking means and then reversing said drive means such that said second transmission drives the stacking means to complete the stack.

13. A method of operating sheet feeding apparatus for feeding sheets from a stack of sheets at an input store to a stacking position, in order to generate a stack of N sheets, the apparatus comprising stripper means for drawing sheets out of said input store, said stripper means including at least one roller; transport means including at least one pair of rollers defining a nip into which single sheets are fed by said stripper means; rotatable stacking means at said stacking position to which sheets are delivered by said transport means; and drive means for driving said stripper means, transport means and said stacking means whereby said stacking means is actuable to continue to stack sheets when said stripper and transport means are controlled to prevent further sheets being fed, characterised in that said at least one stripper means roller and one of each pair of said transport means rollers are mounted non-rotatably to a common shaft, said drive means commonly drives said stripper means, said transport means, and said stacking means, said stacking means being mounted non-rotatably on a shaft coupled via a single direction free-wheel clutch to said common drive means, whereby said stacking means can continue to rotate after said stripper and transport means have stopped the method comprising operating said stripper and transport means and stacking means at a first speed; counting sheets drawn out of the input store and, when a predetermined number of sheets X, where N>X, has been counted, causing said stripper means, said transport means and said stacking means to operate at a lower, second speed; and when the Nth sheet has been withdrawn from said store, braking said stripper and said transport means to prevent further sheets being drawn from said store, said stacking means continuing to rotate so as to stack the sheets already fed out of said store.

* * * * *